US006854452B2

(12) United States Patent
Morinaga et al.

(10) Patent No.: US 6,854,452 B2
(45) Date of Patent: Feb. 15, 2005

(54) FUEL VAPOR HANDLING SYSTEM

(75) Inventors: Syujiro Morinaga, Takahama (JP); Yoshinori Maegawa, Obu (JP); Keiji Wakahara, Inazawa (JP); Makoto Miwa, Kariya (JP)

(73) Assignee: Denso Corporation, Kariya (JP)

( * ) Notice: Subject to any disclaimer, the term of this patent is extended or adjusted under 35 U.S.C. 154(b) by 32 days.

(21) Appl. No.: 10/273,186

(22) Filed: Oct. 18, 2002

(65) Prior Publication Data

US 2003/0075156 A1 Apr. 24, 2003

(30) Foreign Application Priority Data

Oct. 18, 2001 (JP) ..... 2001-320468

(51) Int. Cl.[7] ..... F02M 33/04
(52) U.S. Cl. ..... 123/519; 123/520
(58) Field of Search ..... 123/516–520, 123/198 D, 198 DB; 73/118.1

(56) References Cited

U.S. PATENT DOCUMENTS 5,263,462 A 11/1993 Reddy
5,758,628 A * 6/1998 Wada ..... 123/520
5,803,055 A 9/1998 Goto et al.
6,119,663 A * 9/2000 Okuma ..... 123/520
6,192,742 B1 2/2001 Miwa et al.
6,283,097 B1 * 9/2001 Cook et al. ..... 123/520
6,321,728 B1 * 11/2001 Ohkuma ..... 123/520

FOREIGN PATENT DOCUMENTS

JP 11326110 11/1999

* cited by examiner

*Primary Examiner*—Thomas Moulis
(74) *Attorney, Agent, or Firm*—Nixon & Vandderhye P.C.

(57) ABSTRACT

In a fuel vapor handling system of this invention, an ECU performs a leak check to check a leak of fuel vapor in a fuel vapor passage when the engine is at a stop. The ECU functions to detect the quantity of fuel during the engine stop. The ECU detects the quantity of fuel at the time of engine starting. Furthermore, the ECU compares the quantity of fuel measured at the time of engine starting with the quantity of fuel measured at the preceding engine stop, to thereby determine whether a filler cap was opened during the engine stop. When the filler cap was opened during the engine stop, a result of the leak check will be cancelled. When the filler cap was not opened, the result of the leak check will be determined.

26 Claims, 9 Drawing Sheets

FUEL VAPOR HANDLING SYSTEM

CROSS REFERENCE TO RELATED APPLICATION

This application is based on Japanese Patent Application No. 2001-320468 filed on Oct. 18, 2001 the contents of which are incorporated herein by reference.

BACKGROUND OF THE INVENTION

1. Field of the Invention

This invention relates to a fuel vapor handling system for handling fuel vapor present in a fuel tank, and more particularly to a system equipped with a leak check device which detects a vapor leak in a passage including the fuel tank.

2. Description of Related Art

There has been known the adoption of a canister which traps fuel vapor for the purpose of preventing the discharge of the fuel vapor out of the fuel tank. Furthermore, also known is a fuel vapor handling system which is designed to drive out the fuel vapor trapped in the canister, to thereby supply the fuel vapor through an engine intake passage into the engine, in which the fuel vapor is combusted. This system is also called a fuel vapor purge system.

In the fuel vapor handling system, it is important to detect a vapor leak in the passage of the system in order to prevent the discharge of the fuel vapor. The leak can be detected on the basis of a pressure variation by for example monitoring a pressure in the passage. This leak detection can be conducted for example during engine operation. During engine operation, however, it is difficult to ensure stability suitable for leak detection because of changes in the operating condition of the engine and the movement of a motor vehicle. On the other hand, leak can be detected while the engine is at a stop. The detection of vapor leak executable after stopping the engine has been disclosed in U.S. Pat. No. 5,263,462 for example. However, even after the engine is stopped, there occurs an event which disturbs leak detection, such as the opening of a filler cap of the fuel tank to fill the fuel to the engine.

SUMMARY OF THE INVENTION

It is an object of this invention to provide a fuel vapor handling system which is capable of accurate leak detection.

It is another object of this invention to provide a fuel vapor handling system which is capable of accurate leak detection after the engine is stopped.

It is further another object of this invention to provide a fuel vapor handling system which is capable of preventing a leak detection error likely to occur when the filler cap is opened.

According to one feature of this invention, a vapor leak in the fuel vapor passage including the fuel tank is checked in accordance with a pressure in the passage. When it has been determined that the filler cap of the fuel tank is opened, a processing is executed to prevent an error check likely to be caused by a check means. As a result, it becomes possible to prevent a leak detection error even when the pressure in the fuel vapor passage is changed by the opening of the filler cap.

The check means may be provided with for instance a sensor for detecting a pressure in the fuel vapor passage inclusive of the fuel tank, and a means of comparing a pressure change in fuel vapor passage and a given change indicating a leak. Whether the filler cap is open is detected by a change in quantity of fuel or a pressure in the fuel vapor passage, or by means of a sensor or a switch.

The leak detection error can be prevented for example by canceling a result of the check by the check means, or by discontinuing a check procedure by the check means.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

[First Embodiment]

Figure 1:
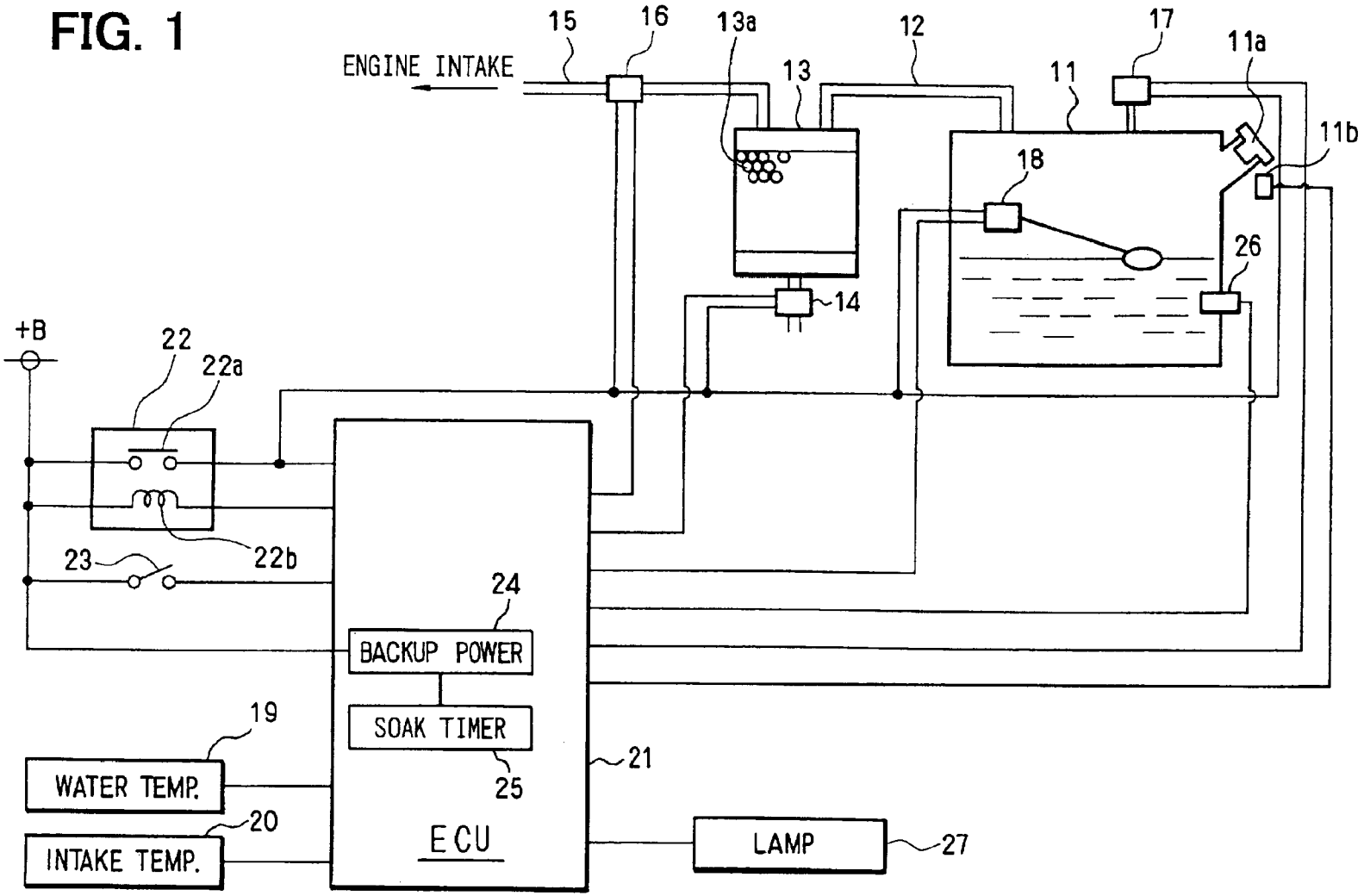
FIG. 1 is a block diagram showing the structure of a fuel vapor handling system in a first embodiment of this invention.

A fuel vapor handling system according to the first embodiment of this invention will be described below with reference of FIGS. 1 to 5. First, the structure of the fuel vapor handling system will be explained by referring to FIG. 1. A canister 13 is connected to a fuel tank 11 through a fuel vapor passage 12. In the canister 13 is housed an adsorbent 13*a*, such as an activated carbon, for the adsorption of the fuel vapor. A canister valve 14 is attached to an air communicating port located at the bottom of the canister 13.

The canister valve 14 is a normally open type solenoid valve, which is in an open position when the power is off, holding the air communicating port of the canister 13 open to the atmosphere. When the power is supplied, however, the canister valve 14 is closed to also close the air communicating port of the canister 13.

On the other hand, connected between the canister 13 and an engine intake system is a purge passage 15 for purging a fuel vapor adsorbed by the adsorbent in the canister 13 out to the engine intake system. In the purge passage 15, a purge valve 16 is inserted to control the flow rate of the fuel vapor. The purge valve 16 is a normally closed type solenoid valve, which is designed to perform the duty control of the electric current to control the flow rate of the fuel vapor flowing from the canister 13 into the engine intake system.

The fuel tank 11 is fitted with a tank pressure sensor 17 (a means of detecting pressure) for the detection of a fuel tank pressure. When the fuel vapor passage from the inside of the fuel tank 11 to the purge valve 16 is in the closed position, the pressure in the fuel tank 11 agrees with pressure in other part of the passage. Therefore, it is possible to see the pressure in the fuel vapor passage by detecting the pressure in the fuel tank 11 (hereafter called "the tank pressure").

In the fuel tank 11 are installed a fuel level sensor (a means of detecting the quantity of fuel) for the detection of the quantity of fuel L and a fuel temperature sensor 26 for the detection of fuel temperature TF. Installed on the fuel tank 11 are various sensors such as a water temperature sensor 19 for detecting an engine coolant temperature and an intake temperature sensor 20 for detecting an intake air temperature.

The output from these sensors is inputted to a control circuit 21. To a power supply terminal of the control circuit 21, the power supply voltage +B is supplied from a vehicle-mounted battery through a main relay 22. The power supply voltage +B is supplied also to the canister valve 14, the purge valve 16, and the tank pressure sensor 17 through the main relay 22. A relay drive coil 22*b* which drives a relay contact 22*a* of the main relay 22 is connected to a main relay control terminal of the control circuit 21. When the relay drive coil 22*b* is energized, the relay contact 22*a* is closed (ON) to supply the power supply voltage to the control circuit 21, the canister valve 14, the purge valve 16, and the tank pressure sensor 17. When the relay drive coil 22*b* is de-energized (OFF), the relay contact 22*a* is opened (OFF), ceasing the supply of the current to the control circuit 21. To a key switch terminal of the control circuit 21, an ON/OFF signal is inputted via an ignition switch (hereafter call "the IG switch") 23. In the control circuit 21 are built a backup power source 24, and a soak timer 25 which is driven by the power from the backup power source 24 to measure time. The soak timer 25 starts measuring a time after the engine is stopped (after the IG switch 23 is turned to OFF) to measure an elapsed time until the engine comes to a full stop.

The control circuit (ECU) 21 incorporates a microcomputer. The ECU 21 executes a fuel injection control routine, ignition control routine, and a purge control routine, thereby conducting the fuel injection control, ignition control, and purge control. Furthermore, the ECU 21 executes each routine of leak checks shown in FIGS. 2 and 3 stored in a ROM, thereby checking to see whether the fuel vapor is leaking, on the basis of the tank pressure (the fuel vapor passage pressure) after the engine is stopped (after the IG switch 23 is turned to OFF). Furthermore, at the subsequent start of the engine (when the IG switch 23 is turned to ON), the ECU 21 determines whether the filler cap 11 of the fuel tank 11 was opened when the engine was at a stop. When the ECU 21 has determined that the filler cap was opened during the engine stop, a result of the leak check will be canceled. Furthermore, the ECU 21 performs a main relay control routine shown in FIG. 4 stored in the ROM, to supply the power to components (the ECU 21, canister valve 14, etc.) necessary for conducting the leak check after the engine is stopped.

Here, description will be given in detail of the first preferred embodiment of the leak check. Immediately after the engine is stopped (after the IG switch is turned to OFF), the purge valve 16 is closed and the canister valve 14 is also closed to fully close the fuel vapor passage. Immediately after the engine stopped, the exhaust system temperature remains high. Therefore, the fuel temperature in the fuel tank 11 is kept by the heat at a temperature at which the fuel vapor is likely to occur, allowing an increase in amount of fuel vapor. Consequently, if the fuel vapor passage is fully closed immediately after the engine is stopped, there largely increases a tank pressure (a pressure rise in the fuel vapor passage) caused by the fuel vapor when no vapor is leaking. (See a solid line in FIG. 5.)

On the other hand, when the fuel vapor is leaking, the fuel vapor leaks out into the atmosphere at the leak hole of the fuel vapor passage if the passage is fully closed. Therefore, the rate of the tank pressure rise (the fuel vapor pressure rise) after fully closing of the fuel vapor passage decreases, thus resulting in a tank pressure drop to the vicinity of the atmospheric pressure in a relatively short period of time. (See a dotted line in FIG. 5.)

In the first embodiment, the tank pressure (gauge pressure=absolute pressure−atmospheric pressure) detected at a gauge pressure (a reference atmospheric pressure) by the tank pressure sensor 17 during the period of leak check, is integrated at given intervals of operation for the purpose of showing, in a numerical form, the behavior of the tank pressure during a leak check. After the completion of the leak check, the integrated value of tank pressure is compared with the determined leak values in order to check for leaks.

Figure 5:
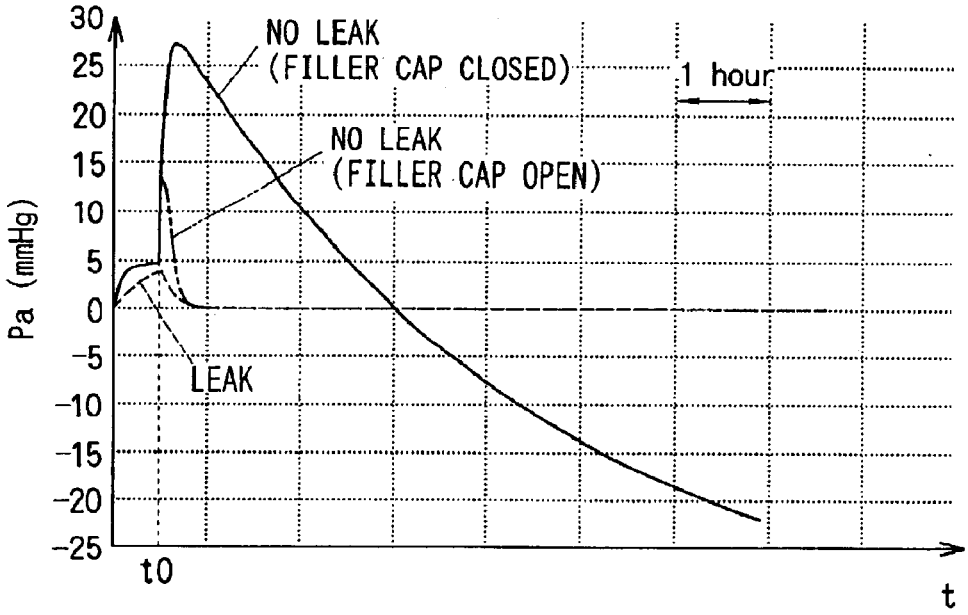
FIG. 5 is a time chart showing a pressure behavior in a fuel tank after a stop of the engine.

By the way, there are cases that, while the engine is at a stop, the filler cap (not shown) of the fuel tank 11 is opened to refill the fuel. If the filler cap is opened, the atmospheric pressure is allowed rapidly into the fuel tank 11 (the fuel vapor passage) at the filler cap, causing the tank pressure (the fuel vapor passage pressure) to the vicinity of the atmospheric pressure. (See a two-dot chain line in FIG. 5.) When a leak check is conducted on the basis of the tank pressure (the fuel vapor passage pressure) with the engine at a stop, the tank pressure drops to the vicinity of the atmospheric pressure if the filler cap is open, like in the case a large quantity of fuel vapor is leaking into the fuel vapor passage. This tank pressure drop will probably cause a check error of LEAK. In FIG. 5, the time t0 indicates that the engine is at a stop.

Usually, the filler cap of the fuel tank 11 is opened only when refilling the fuel. If the fuel is refilled with the filler cap opened, the quantity of fuel in the fuel tank 11 increases. In the first embodiment, therefore, a comparison is made, at the time of engine starting, between the quantity of fuel remaining at the time of the last stop of the engine and the quantity of fuel at the time of engine starting, to thereby check to see whether the filler cap of the fuel tank 11 was open during the stop of the engine. When a result of this check indicates that the filler cap was opened during the stop of the engine, it is determined probable that the leak check was conducted on the basis of the fuel vapor passage pressure affected by the entrance of the atmospheric pressure resulting from opening the filler cap. The result of the leak check, therefore, is canceled to prevent a leak check error likely to be caused by opening the filler cap.

Figure 2:
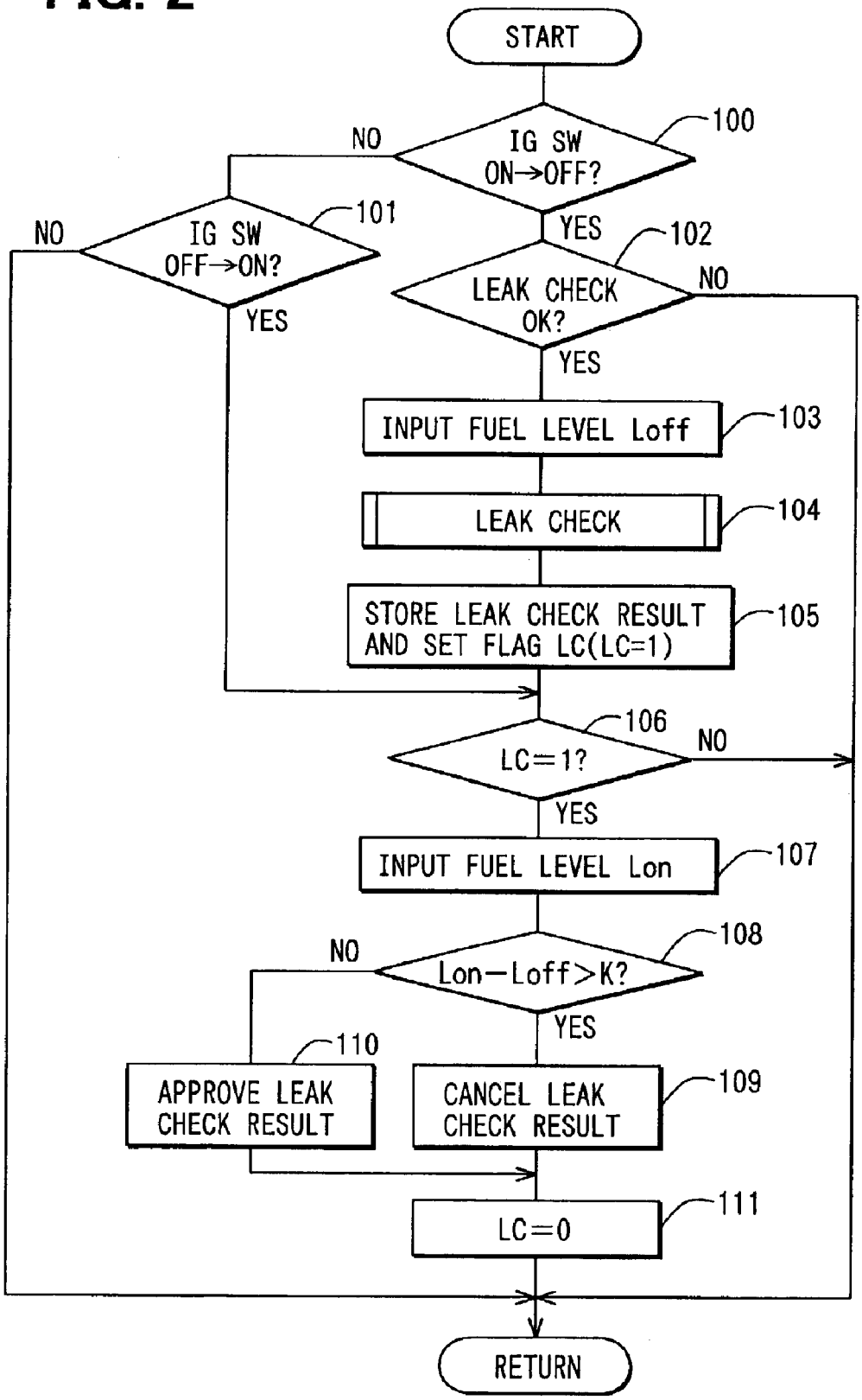
FIG. 2 is a flowchart showing a processing in the first embodiment of this invention.
Figure 3:
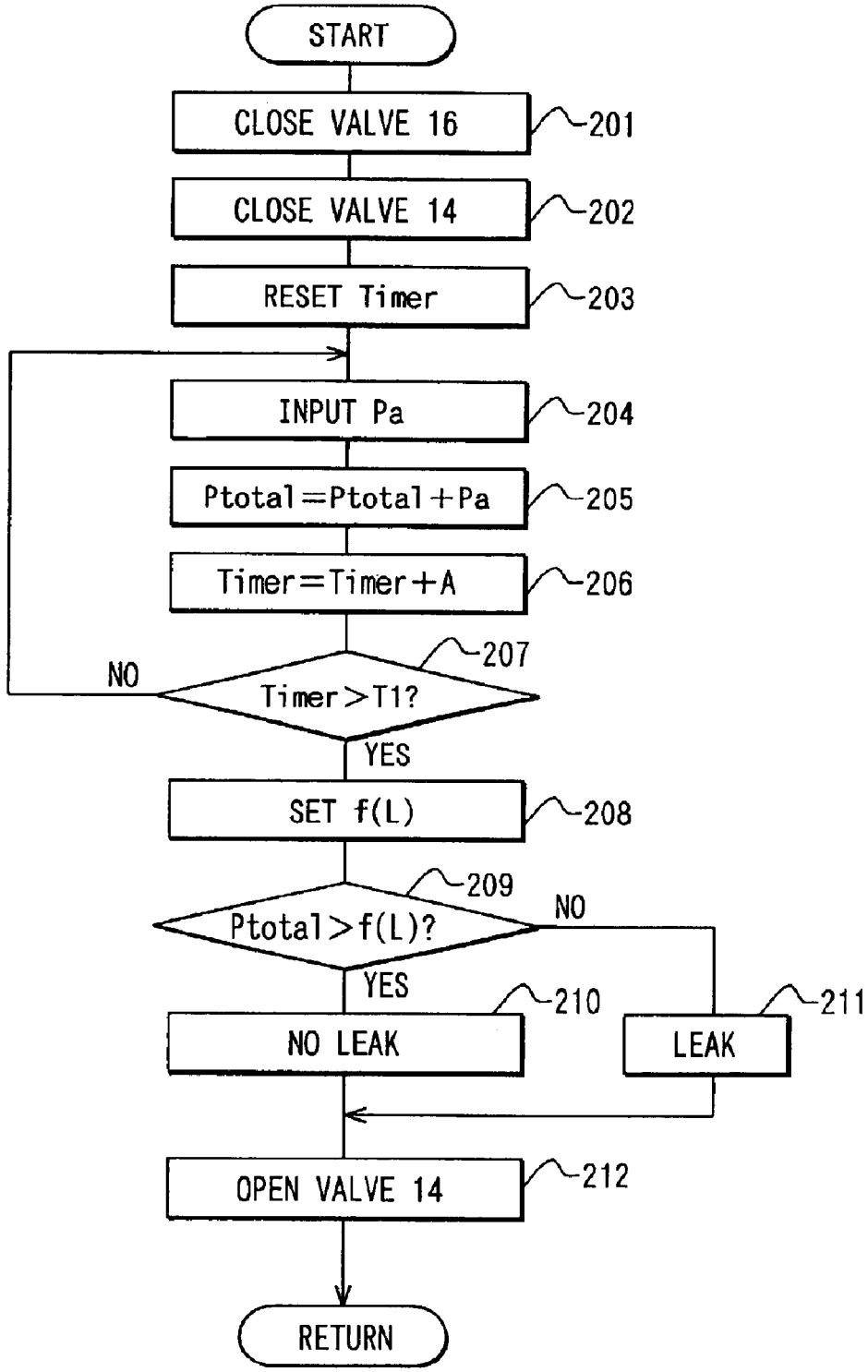
FIG. 3 is a flowchart showing the processing in the first embodiment of this invention.

The leak check explained above is executed in accordance with each routine in FIGS. 2 and 3. The leak check control base routine in FIG. 2 is periodically executed when the electric power is being supplied to the control circuit 21 (when the main relay 22 is ON). At Step 100, it is determined whether the filler cap is opened immediately after the IG switch is turned from ON to OFF, that is, immediately after the engine is stopped. If immediately after the IG switch 23 is turned to OFF, the routine proceeds to Step 102, where it is determined whether conditions necessary for executing the leak check have been established. Usable as the leak check executing conditions is a fuel temperature detected by for instance the fuel temperature sensor 26, which should be above the given temperature at which the fuel vapor is likely to occur. For example, if the fuel temperature Tf is over the given temperature, the leak check executing conditions will be established.

For determining the leak check executing conditions, the fuel temperature may be substituted for by such parameters having a correlation to the fuel temperature as a running history (running time and mileage) before the engine is stopped, and an engine running condition (coolant temperature, etc.). For example, the fuel vapor handling system may be so designed that the leak check executing conditions are established when the running time exceeds the given time, or the mileage exceeds the given value.

When it is determined that the leak check executing conditions have been established, the routine proceeds to Step 103. At Step 103, the IG switch 23 is turned to OFF, so that an output signal from the fuel level sensor 18 is read before the voltage to be supplied to the fuel level sensor 18 drops below the normal operating voltage. Thus the quantity of fuel Loff remaining in the fuel tank 11 is detected when the engine is at a stop. Thereafter, the routine proceeds to Step 104, where the later-described leak check routine of FIG. 3 is executed. At Step 104, the leak check is performed on the fuel vapor passage during a stop of the engine, to thereby temporarily determine LEAK (ABNORMAL) or NO LEAK (NORMAL).

At Step 105, prior to lowering, below the normal operating voltage, the voltage supplied to the control circuit 21 when the main relay 22 is turned OFF with the end of the leak check conducted in accordance with the later-described main relay control routine of FIG. 4, a result of the leak check (NORMAL code or ABNORMAL code) is stored in a backup RAM of the ECU 21, and furthermore is stored in the backup RAM with a leak check flag LC set at "1" which denotes the completion of the leak check. The storage of the leak check result and the leak check flag LC=1 continues even after the interruption of power supply to the ECU 21.

Thereafter, when the IG switch 23 is turned from OFF to ON to start the engine, the present routine is started to determine NO at Step 100 and YES at Step 101, then proceeding to Step 106 to make a determination on whether the leak check flag LC has been set at "1" which signifies the completion of the leak check.

At Step 106, when the determination is made that the leak check flag LC=1, the routine goes to Step 107. At Step 107, an output signal from the fuel level sensor 18 at this point of time is read in, thereby detecting the quantity of fuel Lon in the fuel tank 11 when the engine is started. Subsequently, at Step 108, it is determined whether a difference between the quantity of fuel Lon at the time of engine starting and the quantity of fuel Loff at the time of a preceding engine stop (an increased quantity of fuel during the engine stop) is larger than the given quantity K which is a little larger than a detection error of the fuel level sensor 18. That is, the determination is made on whether the fuel was refilled during the engine stop, or in other words on whether the filler cap 11*a* of the fuel tank 11 was opened during the engine stop. The processing at Step 108 plays a role as a means for determining whether the filler cap is opened.

At Step 108, when a result of the processing is YES, it is determined that a leak check was conducted on the basis of the fuel vapor passage pressure affected by the entry of the atmospheric pressure resulting from opening the filler cap. Then, the routine proceeds to Step 109. At Step 109, the result of a temporary leak check stored in the backup RAM is cleared to cancel the same result. The processing at Step 109 plays a role as a means for preventing a leak check error.

When the result of the processing is NO at Step 108, the result of the temporary leak check stored in the backup RAM is determined. Furthermore when, at Step 110, the result indicates LEAK, a warning lamp 27 is lit to give a warning to the driver.

When the routine proceeds to Step 111 from Step 109 or 110, the leak check flag LC is reset to "0", thereby ending the routine.

The leak check routine of FIG. 3 to be executed at Step 104 of FIG. 2 acts as a leak check means. At Step 201, the purge valve 16 is closed. At Step 202 the canister valve 14 is closed to fully close the fuel vapor passage.

At Step 203, the timer Timer for measuring the elapsed time after the beginning of the leak check (after the fuel vapor passage is closed) is reset. At Step 204, the output signal from the tank pressure sensor 17 is read in to detect the current tank pressure Pa. At Step 105, the current tank pressure Pa is added to the integrated value Ptotal of the preceding tank pressures, thereby updating the integrated value Ptotal of the tank pressures. At this time the tank pressure Pa is measured by the use of a gauge pressure (=absolute pressure−atmospheric pressure) detected with reference to the atmospheric pressure. Then, at Step 206, a computation cycle A is added to the preceding value of the timer Timer, thereby updating the count of the timer Timer.

At Step 207, it is determined whether the count of the timer Timer, or the elapsed time after the start of leak check, exceeds the given time T1. The given time T1 may be a fixed value (e.g., 5 min.) for the purpose of simplifying the operation processing, or may be corrected in accordance with the running history (running time and mileage) and engine running conditions (coolant temperature, etc.) before the engine is stopped.

When the given value T1 is not exceeded by the count of the timer Timer, the routine goes back to Step 204, thereby repeating the update of the integrated value Ptotal of the tank pressure by integrating the tank pressure Pa with a given operation cycle A until the count of the timer Timer exceeds the given value T1.

At the time when the count of the timer Timer has exceeded the given value T1, the routine proceeds to Step 208. At Step 208, the determined leak value f(L) corresponding to the quantity of fuel Loff remaining at the time of an engine stop is read in (or mathematically calculated) from a map of the determined leak value using the quantity of fuel Loff as a parameter. At Step 209, the integrated value of tank pressure Ptotal is compared with the determined leak value f(L). If the integrated value of tank pressure Ptotal exceeds the determined leak value f(L), the routine proceeds to Step 210. At Step 210, a determination of NO LEAK (NORMAL) is temporarily made. At Step 212, the canister valve 14 is opened to finish the leak check.

On the other hand, if it is determined at Step 209 that the integrated value of tank pressure Ptotal is under the determined leak value f(L), the routine proceeds to Step 211, where LEAK (ABNORMAL) is temporarily determined. At Step 212, the canister valve 14 is opened to end the leak check.

Figure 4:
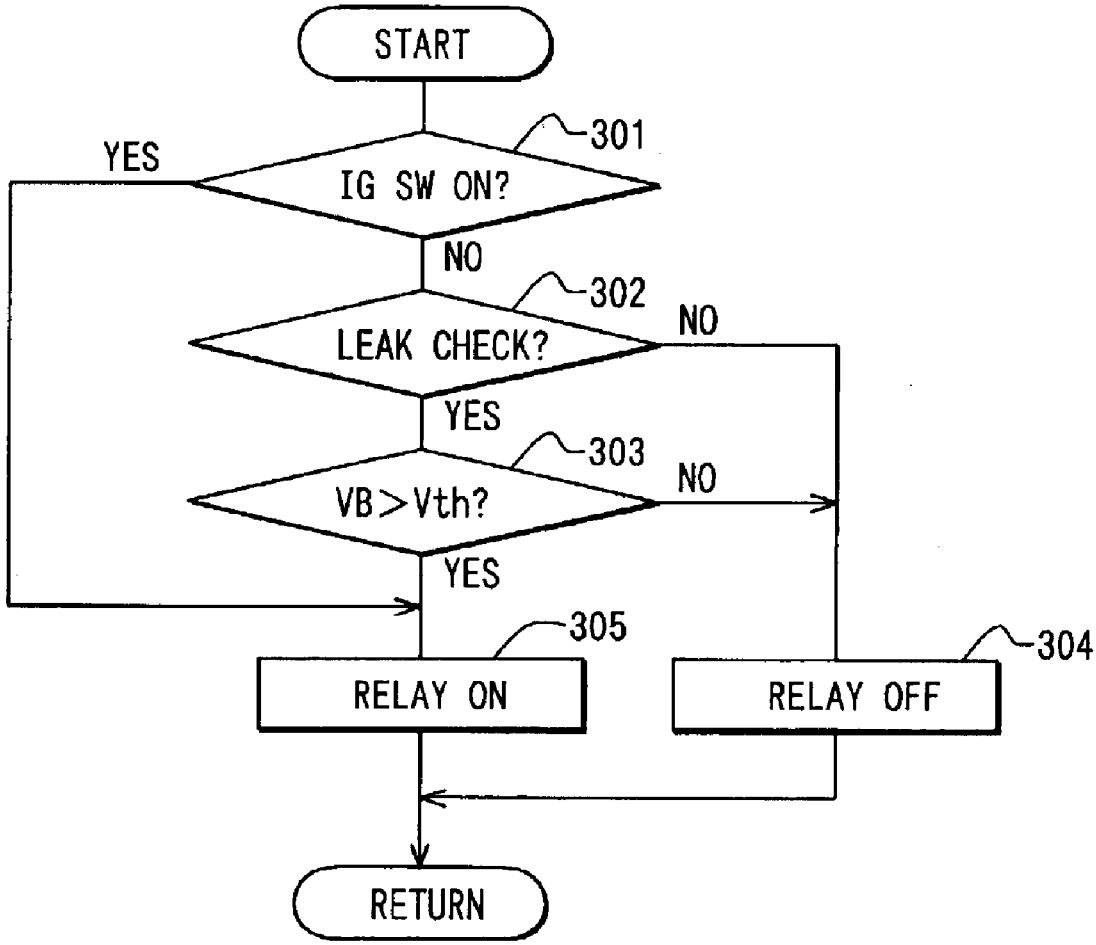
FIG. 4 is a flowchart showing the processing in the first embodiment of this invention.

The main relay control routine in FIG. 4 is executed at every given time to control the ON/OFF operation of the main relay 22. At Step 301, it is checked to see whether the IG switch 23 is in the ON position, that is, whether the engine is operating. When the IG switch 23 is in the ON position, the routine proceeds to Step 305. At Step 305, the main relay 22 is held in the ON position, supplying the power voltage to the ECU 21, canister valve 14, purge valve 16, and tank pressure sensor 17.

Subsequently, when the IG switch 23 is turned from ON to OFF, NO is determined at Step 301 and the routine goes to Step 302. At Step 302, it is determined whether the leak check by the leak check routine of FIG. 3 is now being executed. If the leak check is not underway, the routine proceeds to Step 304. At Step 304, the main relay 22 is released (OFF) to interrupt power supply to the ECU 21, canister valve 14, purge valve 16, and tank pressure sensor 17.

On the contrary, when a determination is made at Step 302 that the leak check is underway, the routine proceeds to Step 303. At Step 303, it is determined whether the power voltage VB is greater than the given voltage Vth at which engine startability can be secured. If the power voltage is below the given voltage, the routine proceeds to Step 304. At Step 304, the main relay 22 is released (OFF) even if the leak check is underway, to interrupt power supply to the ECU 21, canister valve 14, etc., thereby stopping the leak check to prevent battery consumption.

On the other hand, if the power voltage is higher than the given voltage, the routine proceeds to Step 305. At Step 305, the main relay 22 is held in the ON position to continue the supply of power to components (the ECU 21, canister valve e14, etc.) necessary for continuing the leak check even after the IG switch 23 is turned to OFF (after the engine is stopped). At the time of completion of the leak check, NO is determined at Step 302, then proceeding to Step 304, whereat the main relay 22 is released (OFF) to interrupt the supply of power to the ECU 21, canister valve 14, etc.

In the present first embodiment explained above, it is possible to prevent such an error check that LEAK is indicated notwithstanding the absence of a leak when the filler cap is open. The dependability of leak checks during an engine stop can be improved.

Furthermore, in the present embodiment, a comparison is made, at the time of engine starting, between the quantity of fuel Loff remaining at the time of a preceding engine stop with the quantity of fuel Lon at the time of engine starting, to thereby determine whether the filler cap of the fuel tank 11 was opened during the engine stop. During the engine stop, therefore, it is not needed to monitor the quantity of fuel by means of the fuel level sensor 18. Therefore, the supply of electric power to the fuel level sensor 18 can be stopped, whereby the battery power consumption during the engine stop can be reduced. Besides, neither a switch nor a sensor is needed for detecting filler cap operation, a demand for reducing the manufacturing cost can be satisfied.

In the first embodiment, when it is determined at the time of engine starting that the filler cap was opened when the engine is at a stop, all the results of the leak checks were canceled regardless of NORMAL or ABNORMAL. In this case, however, only the result of determination ABNORMAL (LEAK) may be canceled, while the result of determination NORMAL (NO LEAK) may be left as the result of the final determination.

[Second Embodiment]

If the filler cap is opened after the end of a leak check even when the filler cap was opened when the engine is at a stop, the result of the leak check will not be affected by opening the filler cap.

In the second embodiment of this invention, in view of the circumstances stated above, the leak check will be aborted when it is determined that the filler cap was opened prior to the end of the leak check.

Figure 6:
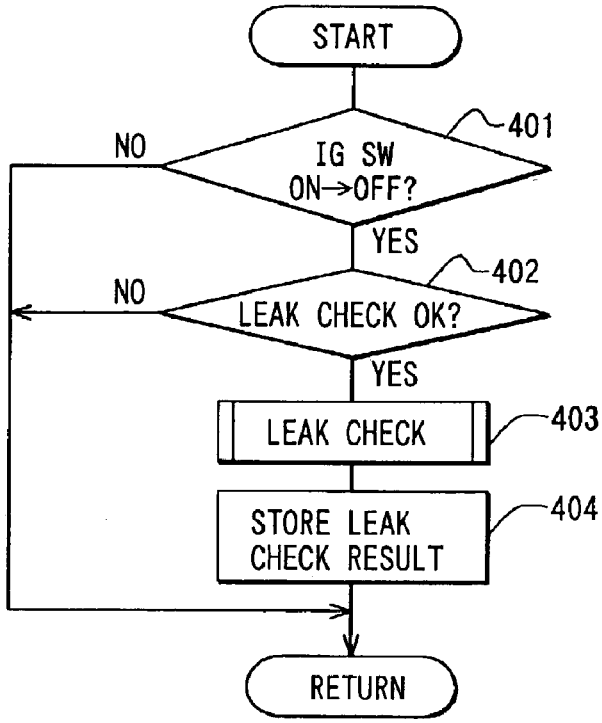
FIG. 6 is a flowchart showing a processing in a second embodiment of this invention.

Now, description will be given below of a leak check control base routine shown in FIG. 6 and details of the processing of the main relay control routine shown in FIG. 7 both used in the present second embodiment.

At Step 401, a determination is made on that the IG switch 23 is turned OFF. At Step 402, it is determined whether the conditions necessary for executing the leak check have been established. When the conditions for executing the leak check have been established, the leak check routine of FIG. 3 will be executed at Step 403. At Step 404, the result of the leak check (NORMAL code or ABNORMAL code) will be stored in the backup RAM of the ECU 21.

Figure 7:
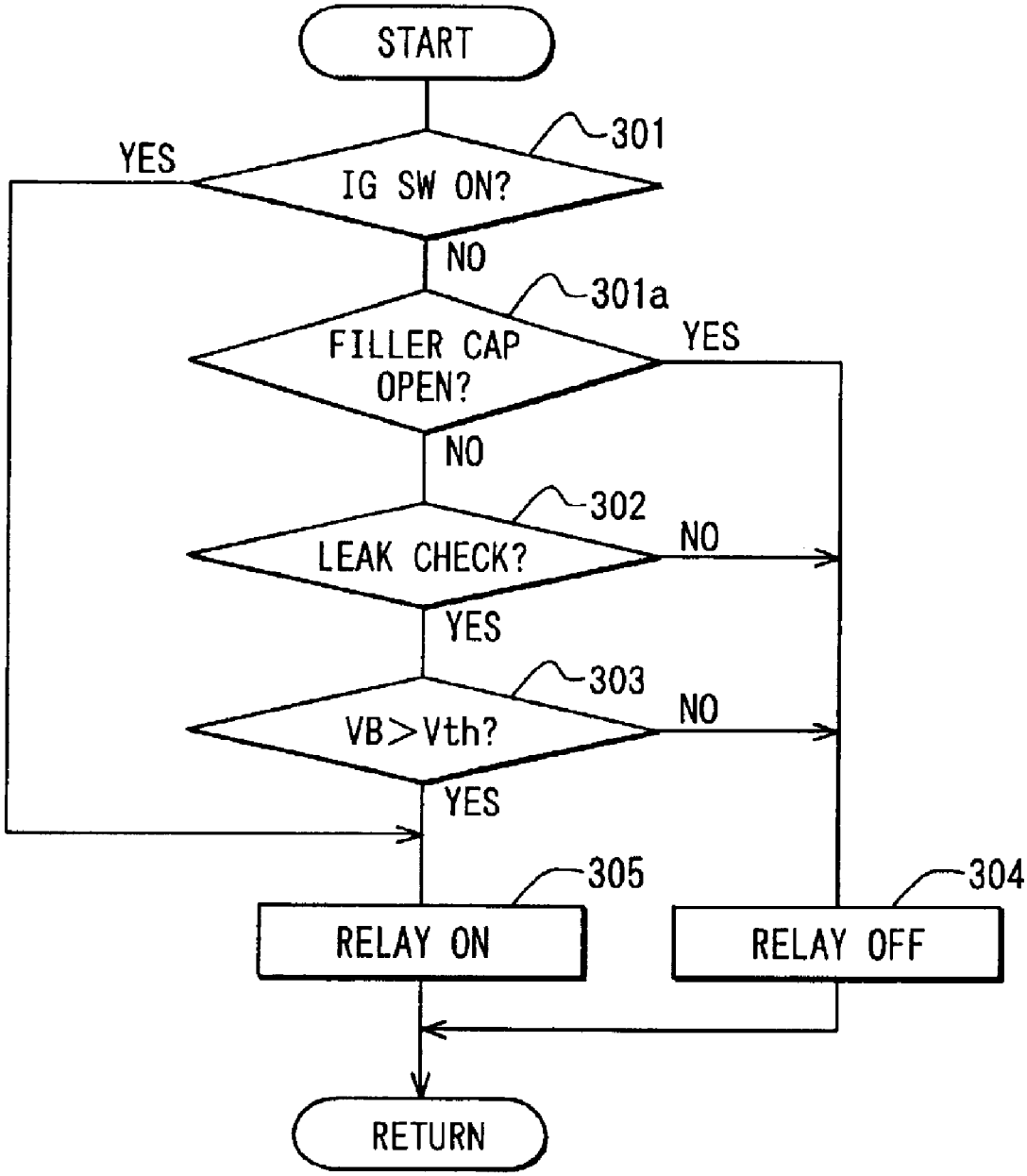
FIG. 7 is a flowchart showing the processing in the second embodiment of this invention.

The main relay control routine of FIG. 7 includes the routine at Step 301*a* added between the routines at Steps 301 and 302 of FIG. 4. Routines at other steps are the same as the main relay control routine of FIG. 4 previously stated.

At Step 301*a*, whether the filler cap of the fuel tank 11 is opened is determined by whether or not the tank pressure has suddenly changed. If the filler cap of the fuel tank 11 is opened, the atmospheric pressure is allowed largely into the fuel tank 11 through the filler cap, suddenly changing the tank pressure toward the atmospheric pressure. Therefore, when the tank pressure has suddenly changed, it is determined that the filler cap of the fuel tank 11 has been opened.

In the second embodiment described above, when the filler cap is opened, the leak check can be interrupted by opening the main relay 22. On the other hand, when the filler cap is opened after finishing the leak check, the result of the preceding leak check will not be affected by opening the filler cap, and therefore may be adopted as it is. Therefore, it is possible to maintain the frequency of the leak check while preventing a leak check error likely to occur when the filler cap is opened.

In the second embodiment the power voltage is supplied to the fuel level sensor 18 through the main relay 22 when the engine is at a stop. When the quantity of fuel detected by the fuel level sensor 18 during the engine stop has increased to exceed a detection error, it may be determined that the filler cap has been opened.

[Third Embodiment]

Figure 8:
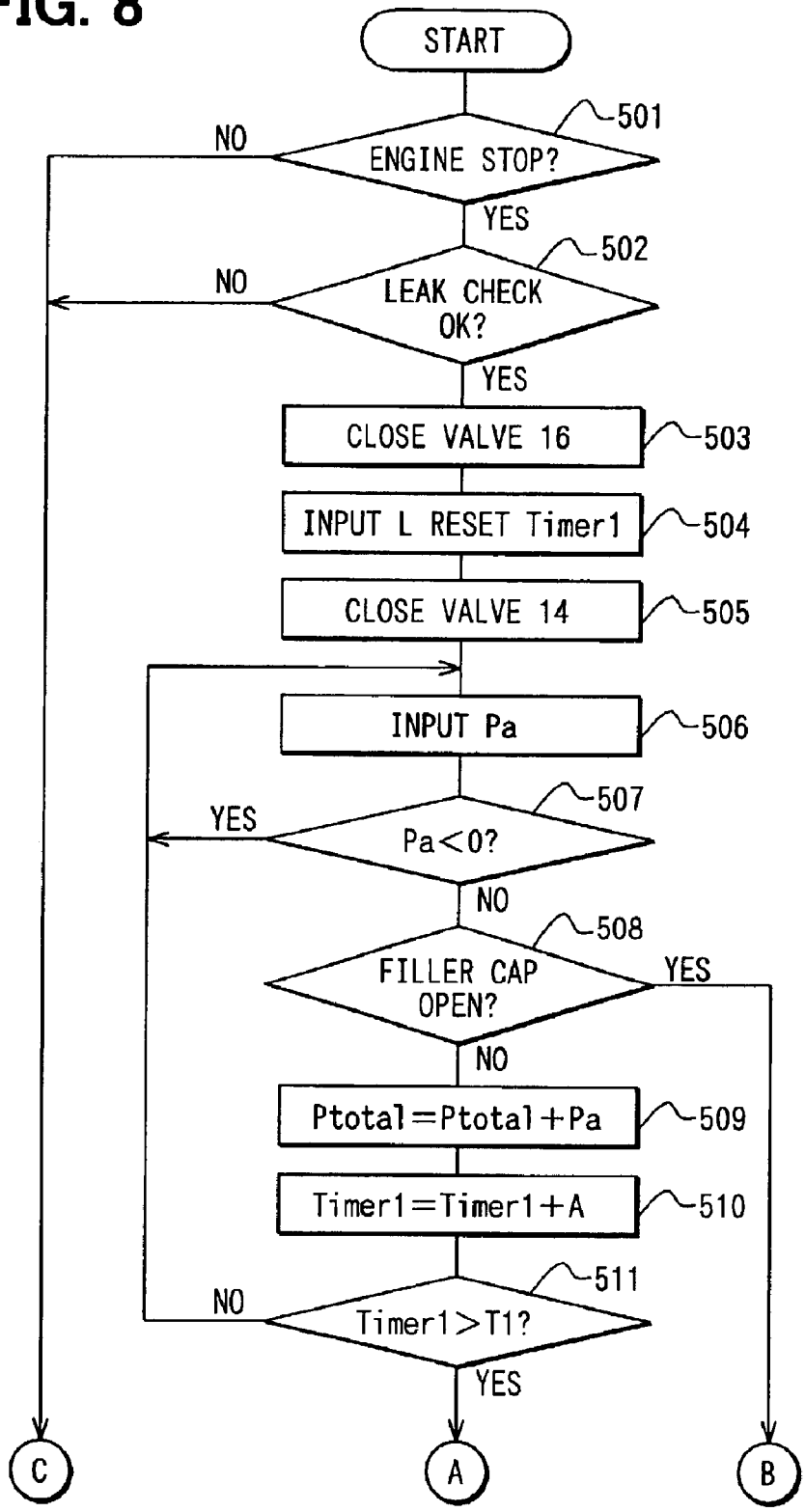
FIG. 8 is a flowchart showing a processing in a third embodiment of this invention.

Next, the third embodiment of this invention will be explained with reference to FIGS. 8 to 10.

Figure 10:
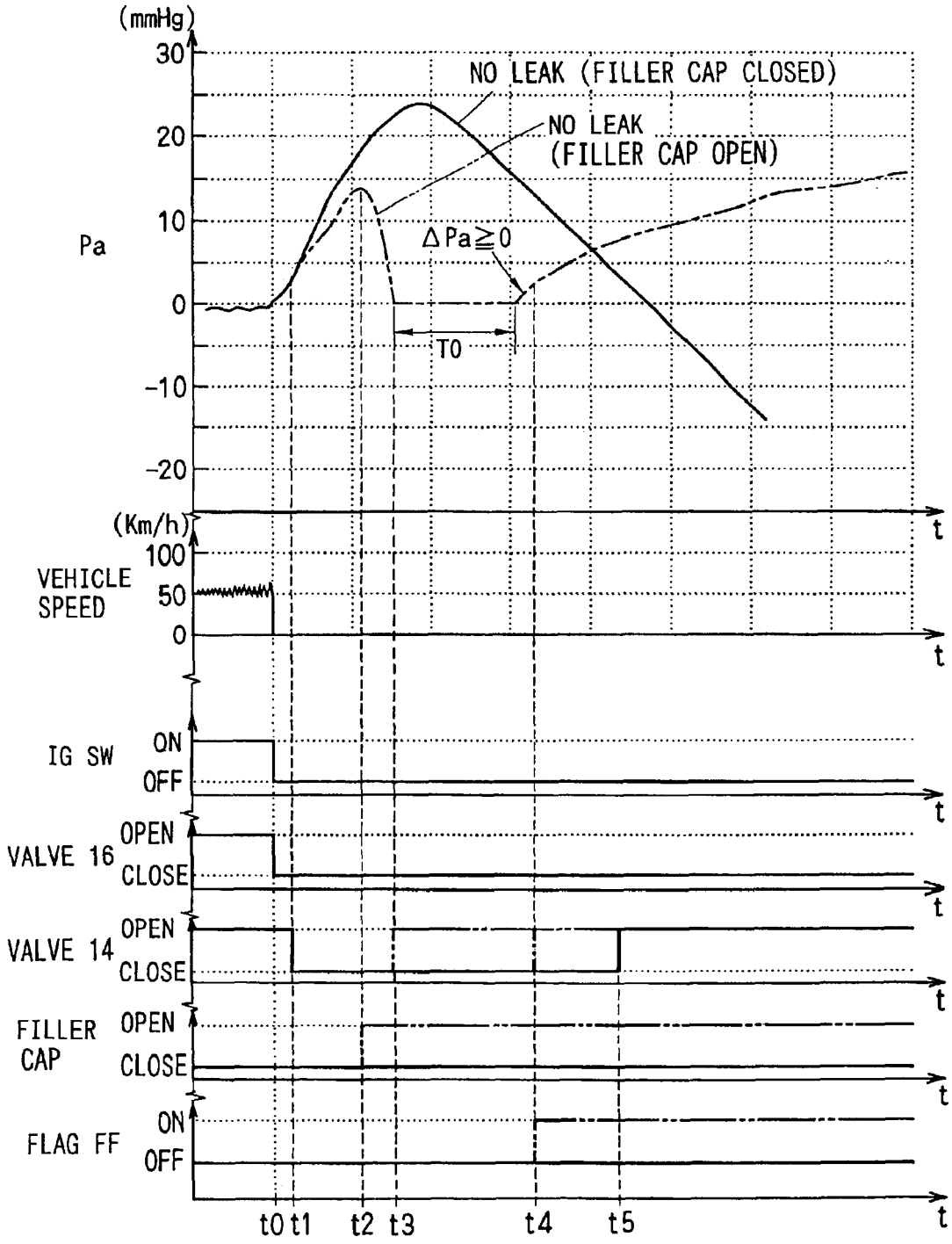
FIG. 10 is a time chart showing the operation of the third embodiment of this invention.

When the filler cap of the fuel tank 11 is opened during the period of leak check after the engine stopped, the tank pressure suddenly drops to the vicinity of the atmospheric pressure as indicated by a two-dot chain line in the time chart of FIG. 10. The tank pressure is maintained at the atmospheric pressure, thereafter gradually increasing when the supply of fuel is commenced with a filler nozzle inserted into a filler port.

In the third embodiment, the leak check is interrupted in response to a change in tank pressure.

Next, processing in the leak check routines to be executed in the present embodiment will be explained in detail with reference to FIGS. 8 and 9. When the leak check executing conditions similar to those in the first embodiment are established after an engine stop (Steps 501 and 502), the routine proceeds to Step 503. At Step 503, the purge valve 16 is closed. At Step 504, the quantity of fuel L is detected and the timer Timer1 is reset. At Step 505, the leak check is started with the canister valve 14 closed to fully close the fuel vapor passage.

At Step 506, the detection of the tank pressure Pa is performed. At Step 507, whether the tank pressure Pa is negative (Pa<0) is checked. If the case of a negative tank pressure Pa, the routine returns to Step 506, where the tank pressure Pa is redetected.

Next, at the time when the tank pressure reached the atmospheric pressure or a positive pressure, or when, with the fuel vapor passage fully closed, the tank pressure Pa began to increase, the routine proceeds to Step 508. At Step 508, it is determined whether the filler cap of the fuel tank 11 was opened. At Step 508, the rate of change of the tank pressure Pa (Pa=current tank pressure Pa−last tank pressure Pa) is calculated. At Step 508, it is determined whether the rate of change of the tank pressure Pa is smaller than the given value P1 (<0). Further at Step 508, the time T1 is the duration when the atmospheric pressure is present in the tank after the engine stopped. After the continuation of the time T1 over the given time T2, a determination is made on whether the rate of change of the tank pressure Pa has increased over 0. The given value P1 is set at a smaller value than the rate of decrease of the tank pressure built up during the period of a normal leak check (in the case of the period indicated by a solid line in FIG. 10). The given time T2 is set at a longer time than the duration when the status of the atmospheric pressure continues during the period of the normal leak check.

At Step 508, where at least either one of two conditions is established, it is determined that the filler cap of the fuel tank 11 is opened, supplying the fuel. As a result, the filler plug FF is set to ON. The processing at Step 508 serves as a means for determining that the filler port is open.

At Step 508, when it is determined that the filler cap of the fuel tank 11 was opened, the leak check processing is canceled, thus ending the routine.

On the other hand, if it is determined that the filler cap of the fuel tank 11 was not opened, the tank pressure Pa is integrated at a predetermined operation cycle A until the value of the timer Timer1 exceeds the given value T1, repeating the update of the integrated value of the tank pressure Ptotal (Steps 509–511).

Figure 9:
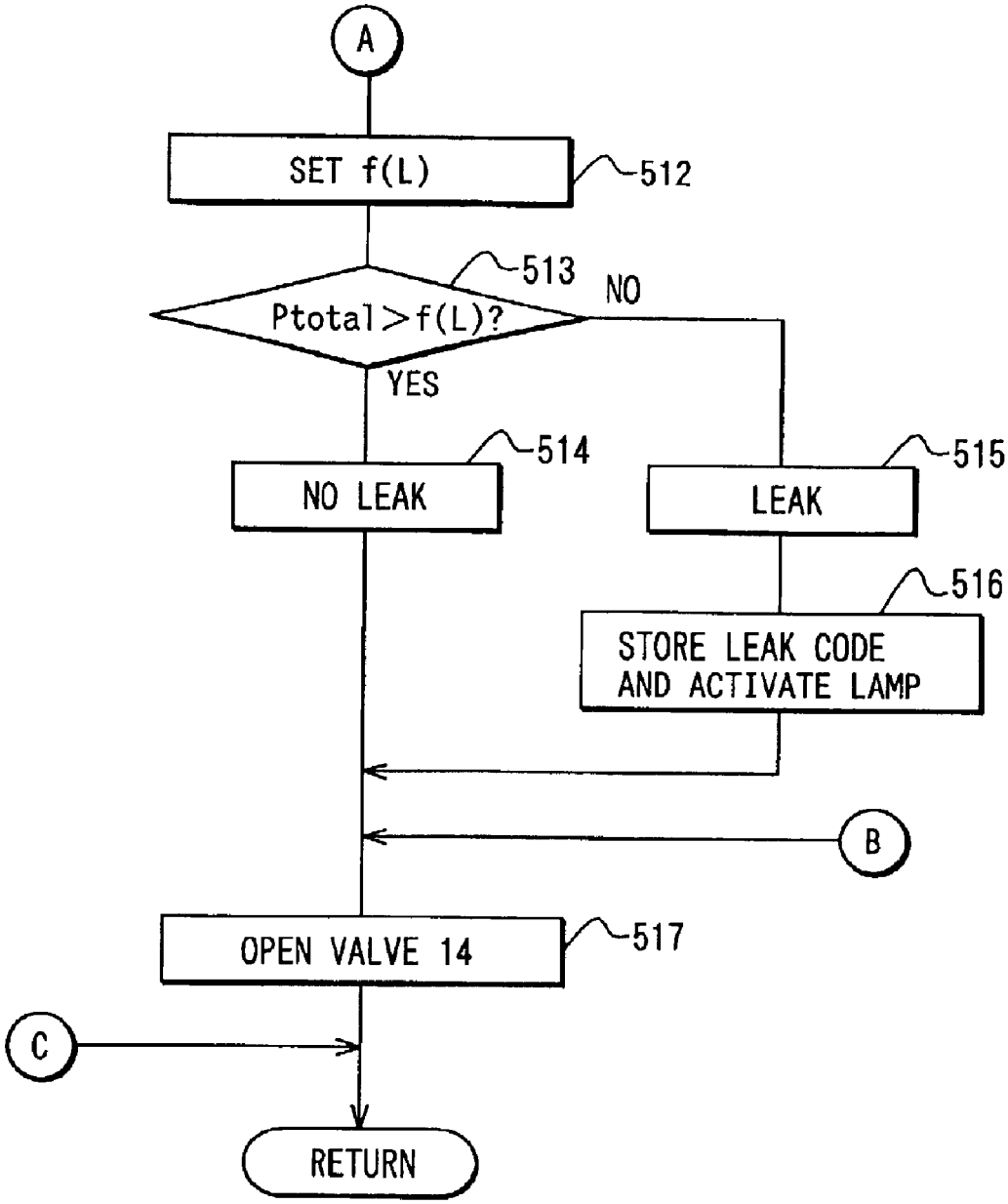
FIG. 9 is a flowchart showing the processing in the third embodiment of this invention.

Thereafter, at the point of time when the value of the timer Timer1 exceeds the given value T1, the routine proceeds to Step 51 of FIG. 9, where the determined value of leak f(L) corresponding to the current quantity of fuel L is read. At Step 513, a comparison is made between the integrated value of tank pressure Ptotal and the determined value of leak f(L). If in this case the integrated value of tank pressure Ptotal is greater than the determined value of leak f(L), the routine proceeds to Step 514, where NO LEAK (NORMAL) is determined. Then, at Step 517, the canister valve 14 is opened to end the leak check.

At Step 513, however, if the integrated value of tank pressure Ptotal is under the determined value of leak f(L), the routine proceeds to Step 515, where LEAK (ABNORMAL) is determined. Then, at Step 516, the warning lamp 27 is lit to give a warning to the driver and at the same time the ABNORMAL code is stored in the backup RAM (not shown) of the ECU 21. Next, at Step 517, the canister valve 14 is opened to end the leak check.

FIG. 10 shows operation of the fuel vapor handling system of the third embodiment. At the time T0, the engine stops. At the time t1, the ECU 21 starts the processing. When the filler cap is in the closed position, the processing ends at the time t5. When the filler cap is opened at the time t2, the processing ends at the time t3 in response to Pa or at the time t4 in response to the time t2.

According to the third embodiment described above, it is possible to prevent the lowering of the leak check frequency while preventing the occurrence of a leak check error likely to be caused by opening the filler cap.

In the second and third embodiments described above, the leak check is canceled immediately when the filler cap is opened prior to ending the leak check. The result of the leak check, however, may be canceled after the leak check is ended. In this case, all the results of leak checks may be canceled regardless of NORMAL or ABNORMAL. In this case, however, only the result of determination ABNORMAL (LEAK) may be canceled, while the result of determination NORMAL (NO LEAK) may be left as the result of the final determination.

In the first to third embodiments described above, LEAK or NO LEAK was checked by comparing the integrated value of the tank pressure obtained by integrating the tank pressure at a given period of computation during the period of the leak check with the determined value of leak. The method of leak check, however, may be altered as occasion calls.

For example, the leak check may be performed by detecting the maximum value of the tank pressure during the period of leak check and comparing the maximum value of the tank pressure with the determined value of leak.

The leak check may be performed by comparing, with the determined value of leak, the tank pressure detected after a lapse of a given period of time after the leak check is started (with the fuel vapor passage fully closed).

Furthermore, the leak check may be performed by monitoring a change in tank pressure after the start of the leak check, measuring the time until the rate of increase in tank pressure lowers below the given value (e.g., approximately 0), and determining LEAK or NO LEAK by checking whether the time is shorter than the determined value of the leak.

Furthermore, the leak check may be performed by detecting whether the tank pressure dropped below the given pressure (e.g., to around the atmospheric pressure) before a lapse of the given time after the start of the leak check.

In the first to third embodiments, the detection (leak check) of the tank pressure is started immediately after stopping the engine with the fuel vapor passage fully closed. In this case, however, the detection (leak check) of the tank pressure may be started after a lapse of some time when a difference in the tank pressure between LEAK and NO LEAK, with the fuel vapor passage fully closed, is clearly indicated.

Furthermore, a switch or a sensor 11*b* for detecting the open/close operation of the filler cap may be installed, so that the open/close operation of the filler cap can be detected accurately and instantly when the filler cap is opened in the case the tank pressure is in the vicinity of the atmospheric pressure or even when the quantity of fuel being supplied (an increased quantity of fuel) is a little.

Furthermore, when a control switch is provided on the driver's seat for the remote control of the filler cap operation, the opening of the filler cap may be detected in accordance with a control signal from the control switch.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel vapor handling system for handling fuel vapors from a fuel tank which holds fuel to be supplied to an engine, said system comprising:

check means which checks for a leak from a fuel vapor passage including the fuel tank on the basis of pressure in the fuel vapor passage when the engine is at a stop;

determination means for determining whether a filler cap of the fuel tank has been opened; and canceling means for canceling at the time of engine starting a leak check error likely to have been caused by the check means, said canceling being in response to a determination that the filler cap has been opened.

2. A fuel vapor handling system as in claim 1, wherein the check means comprises:

a pressure sensor for detecting pressure in the fuel vapor passage including the fuel tank; and comparing means for comparing a change in pressure detected when the engine is at a stop, with a change indicating a leak in the fuel vapor passage.

3. A fuel vapor handling system as in claim 1, wherein the determination means responds to a change in quantity of fuel indicating that the filler cap has been opened.

4. A fuel vapor handling system as in claim 3, wherein the change in quantity of fuel is indicated on the basis of the quantity of fuel when the engine is stopped, and the quantity of fuel when the engine is restarted.

5. A fuel vapor handling system as in claim 3, wherein the determination means responds to an increase in quantity of fuel which indicates that the filler cap has been opened.

6. A fuel vapor handling system as in claim 1, wherein the determination means responds to a pressure in the fuel vapor passage which indicates that the filler cap has been opened.

7. A fuel vapor handling system as in claim 6, wherein the determination means responds to a sudden change in pressure in the fuel vapor passage.

8. In a fuel vapor handling system as in claim 7, wherein the determination means responds to a sudden change in pressure in the fuel vapor passage toward the atmospheric pressure.

9. A fuel vapor handling system as in claim 6, wherein the determination means responds to a sudden pressure drop in the fuel vapor passage.

10. A fuel vapor handling system as in claim 6, wherein the determination means responds to a gradual pressure rise in the fuel vapor passage after a given period of time during which a fixed value of pressure was present.

11. A fuel vapor handling system as in claim 1, wherein the determination means responds to a signal from a sensor or a switch which detects that the filler cap has been opened.

12. A fuel vapor handling system as in claim 1, wherein the check means checks for a leak during a stop of the engine, and the canceling means cancels a result of a leak check made by the check means.

13. A fuel vapor handling system as in claim 1, wherein the check means checks for a leak during a stop of the engine, and the canceling means interrupts the checking procedure being performed by the check means, or cancels the result of a leak check made by the check means during a stop of the engine.

14. A method for handling fuel vapors from a fuel tank which holds fuel to be supplied to an engine, said method comprising:

checking for a leak from a fuel vapor passage including the fuel tank on the basis of pressure in the fuel vapor passage when the engine is at a stop;

determining whether a filler cap of the fuel tank has been opened; and at the time of engine starting, canceling a possibly erroneous leak check result in response to a determination that the filler cap has been opened.

15. A method as in claim 14 wherein the checking step comprises:

detecting pressure in the fuel vapor passage including the fuel tank; and comparing a change in pressure detected when the engine is at a stop with a change indicating a leak in the fuel vapor passage.

16. A method as in claim 14 wherein the determining step responds to a change in quantity of fuel indicating that the filler cap has been opened.

17. A method as in claim 16 wherein the change in quantity of fuel is indicated on the basis of the quantity of fuel when the engine is stopped and the quantity of fuel when the engine is restarted.

18. A method as in claim 16 wherein the determining step responds to an increase in quantity of fuel which indicates that the filler cap has been opened.

19. A method as in claim 14 wherein the determining step responds to a pressure in the fuel vapor passage when indicates that the filler cap has been opened.

20. A method as in claim 19 wherein the determining step responds to a sudden change in pressure in the fuel vapor passage.

21. A method as in claim 20 wherein the determining step responds to a sudden change in pressure in the fuel vapor passage toward the atmospheric pressure.

22. A method as in claim 19 wherein the determining step responds to a sudden pressure drop in the fuel vapor passage.

23. A method as in claim 19 wherein the determining step responds to a gradual pressure rise in the fuel vapor passage after a given period of time during which a fixed value of pressure was present.

24. A method as in claim 14 wherein the determining step responds to a signal from a sensor or a switch which detects that the filler cap has been opened.

25. A method as in claim 14 wherein:

the checking step checks for a leak during a stop of the engine, and the canceling step cancels a result of a leak check made by the checking step.

26. A method as in claim 14 wherein:

the checking step checks for a leak during a stop of the engine, and the canceling step interrupts the checking step or cancels the result of a leak check made by the checking step during a stop of the engine.

* * * * *